US008341932B2

(12) United States Patent
Wiedenhoefer et al.

(10) Patent No.: US 8,341,932 B2
(45) Date of Patent: Jan. 1, 2013

(54) ROTARY AIR VALVE FIRING PATTERNS FOR RESONANCE DETUNING

(75) Inventors: James Fredric Wiedenhoefer, Clifton Park, NY (US); Adam Rasheed, Glenville, NY (US)

(73) Assignee: General Electric Company, Niskayuna, NY (US)

( * ) Notice: Subject to any disclaimer, the term of this patent is extended or adjusted under 35 U.S.C. 154(b) by 940 days.

(21) Appl. No.: 12/407,309

(22) Filed: Mar. 19, 2009

(65) Prior Publication Data

US 2010/0236214 A1 Sep. 23, 2010

(51) Int. Cl.

| | |
|---|---|
| ***F02C 5/02*** | (2006.01) |
| ***F02C 5/12*** | (2006.01) |
| ***F02C 5/00*** | (2006.01) |
| ***F02K 7/00*** | (2006.01) |

(52) U.S. Cl. ..... 60/39.39; 60/39.76; 60/39.38; 60/247

(58) Field of Classification Search ..... 60/247, 60/39.38, 39.76, 39, 78, 39.39, 39.81
See application file for complete search history.

(56) References Cited

U.S. PATENT DOCUMENTS

| | | | | |
|---|---|---|---|---|
| 2,928,242 | A * | 3/1960 | Guenther | 60/39.39 |
| 5,345,758 | A * | 9/1994 | Bussing | 60/39.38 |
| 5,353,588 | A * | 10/1994 | Richard | 60/39.38 |
| 5,513,489 | A * | 5/1996 | Bussing | 60/39.38 |
| 5,983,624 | A * | 11/1999 | Anderson | 60/39.77 |
| 6,062,018 | A * | 5/2000 | Bussing | 60/39.39 |
| 6,637,187 | B2 | 10/2003 | Sanders | |
| 6,931,833 | B2 * | 8/2005 | Lupkes | 60/207 |
| 7,340,903 | B2 * | 3/2008 | Lu et al. | 60/776 |
| 2008/0098710 | A1 | 5/2008 | Janssen et al. | |

* cited by examiner

*Primary Examiner* — William H Rodriguez
*Assistant Examiner* — Gerald Sung
(74) *Attorney, Agent, or Firm* — Penny A. Clarke

(57) ABSTRACT

An engine contains a compressor stage, a plurality of pulse detonation combustors and a rotary inlet valve structure having a plurality of inlet ports through which at least air flows to enter the pulse detonation combustors during operation of the engine. Downstream of the pulse detonation combustors is a turbine stage. Further, the ratio of the pulse detonation combustors to the inlet ports is a non-integer.

16 Claims, 4 Drawing Sheets

ROTARY AIR VALVE FIRING PATTERNS FOR RESONANCE DETUNING

BACKGROUND OF THE INVENTION

This invention relates to pulse detonation systems, and more particularly, rotary air valve firing patterns for resonance detuning.

With the recent development of pulse detonation combustors (PDCs) and engines (PDEs), various efforts have been underway to use PDC/Es in practical applications, such as in aircraft engines and/or as means to generate additional thrust/propulsion. It is noted that the following discussion will be directed to "pulse detonation combustors" (i.e. PDCs). However, the use of this term is intended to include pulse detonation engines, and the like.

Because of the recent development of PDCs and an increased interest in finding practical applications and uses for these devices, there is an increasing interest in implementing PDCs in commercially and operationally viable platforms. Further, there is an increased interest in using multiple PDCs in a single engine or platform so as to increase the overall operational performance. However, because of the nature of their operation, the practical use of multiple PDCs is often limited by some of the operational issues they present, particularly on downstream components. That is, current implementations using multiple PDCs fire (or detonate) the PDCs in a sequential firing pattern.

For example, if a plurality of PDCs are arranged in a circular pattern, they are fired sequentially in a clockwise direction. However, the sequential firing of PDCs can be disadvantageous for a number of reasons.

Specifically, the sequential firing of multiple PDCs can result in creating resonance in downstream components of an engine. The creation of this resonance can result in high cycle fatigue failure in downstream components. Additionally, when one off-axis PDC tube is fired at a time this can create large flow asymmetries can lead to losses downstream as the flow passes through nozzles, etc. Additionally, force loading on downstream components can be asymmetric, thus requiring additional structure and weight to compensate for this loading.

Therefore, there exists a need for an improved method of firing PDCs so that any resonant frequencies are detuned.

SUMMARY OF THE INVENTION

In an embodiment of the present invention, an engine contains a plurality of pulse detonation combustors and a rotary inlet valve structure having a plurality of inlet ports through which at least air flows to enter the plurality of pulse detonation combustors during operation of said engine. The ratio of the pulse detonation combustors to the inlet ports is a non-integer.

As used herein, a "pulse detonation combustor" PDC (also including PDEs) is understood to mean any device or system that produces both a pressure rise and velocity increase from a series of repeating detonations or quasi-detonations within the device. A "quasi-detonation" is a supersonic turbulent combustion process that produces a pressure rise and velocity increase higher than the pressure rise and velocity increase produced by a deflagration wave. Embodiments of PDCs (and PDEs) include a means of igniting a fuel/oxidizer mixture, for example a fuel/air mixture, and a detonation chamber, in which pressure wave fronts initiated by the ignition process coalesce to produce a detonation wave. Each detonation or quasi-detonation is initiated either by external ignition, such as spark discharge or laser pulse, or by gas dynamic processes, such as shock focusing, auto ignition or by another detonation (i.e. cross-fire).

As used herein, "engine" means any device used to generate thrust and/or power.

BRIEF DESCRIPTION OF THE DRAWINGS

The advantages, nature and various additional features of the invention will appear more fully upon consideration of the illustrative embodiment of the invention which is schematically set forth in the figures, in which.

DETAILED DESCRIPTION OF THE INVENTION

The present invention will be explained in further detail by making reference to the accompanying drawings, which do not limit the scope of the invention in any way.

Figure 1:
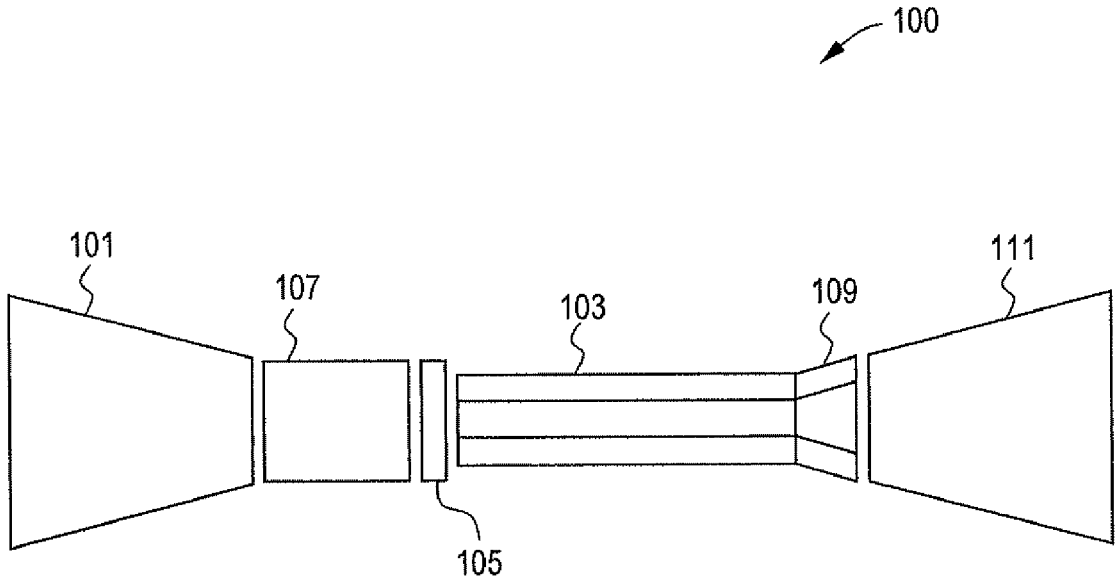
FIG. 1 shows a diagrammatical representation of an engine in accordance with an exemplary embodiment of the present invention.

FIG. 1 depicts an engine 100 in accordance with an embodiment of the present invention. As shown, the engine 100 contains a compressor stage 101, a plurality of PDCs 103 and a turbine stage 111. Each of the compressor stage 101, the PDCs 103 and turbine stage 111 can have a conventional and known structure and configuration. The various embodiments of the present invention are not limited in this regard. Coupled to the PDCs are nozzles 109 which direct the flow from the PDCs 103 into the turbine stage 111. As shown in FIG. 1, the nozzles 109 diverging. However, the nozzles 109 can be of the converging or converging-diverging type. Moreover, in the embodiment shown, each PDC 103 is coupled to its own nozzle 109. However, the present invention is not limited to this specific embodiment as it is contemplated that a single nozzle, plenum and/or manifold structure can be used to direct the flow from the plurality of PDCs to the turbine 111.

Between the PDCs 103 and the compressor stage 101 is an inlet system 107 which comprises an inlet valve structure 105. As shown in the embodiments discussed below, the inlet valve structure 105 is a rotating valve structure which has a plurality of inlet ports 104 to allow the flow from the compressor stage 101 to enter the PDCs 103 for PDC operation. The inlet system 107 may contain a plenum structure and/or drive mechanism to facilitate flow from the compressor stage 101 to the PDCs 103 and drive the inlet valve structure 105. The present invention is not limited by the specific configuration and/or implementation of the inlet system 107, as conventional known and used systems can be employed to implement the various embodiments of the present invention discussed in more detail below.

Turning now to FIGS. 2 through 5, various embodiments of the present invention are depicted. In the various embodiments of the present invention shown, and those not shown, non-sequential PDC firing patterns are employed to decouple the natural modes of the PDC system from the resonance modes of downstream components, such as the turbine stage 111. To accomplish this, embodiments of the present invention employ an inlet valve structure 105 which has a rotary configuration and a plurality of inlet ports 104 to allow the flow of air and/or fuel into the PDCs 103 for PDC operation. In exemplary embodiments of the present invention the ratio of PDCs 103 to inlet ports 104 is a non-integer. By employing this non-integer ratio configuration the firing sequence of PDCs is either a counter-sequential firing pattern (i.e., sequential in the opposite direction of valve rotation) or a skip firing pattern in which adjacent PDCs 103 are skipped during the firing sequence. In skip patterns the firing pattern is in the same direction as the valve rotation. Either of these types of firing patterns results in resonance detuning and thus avoiding the potential problems caused by the prior art. That is resonance decoupling of downstream components (such as the turbine 111) is achieved.

Prior to further discussing the details of the various embodiments of the present invention, it is noted that although the valve structure 105 is depicted as a disk-like air inlet valve, the present invention is not limited to this specific embodiment, although it can be used. Various embodiments of the present invention can use other types of rotating valve geometries and configurations where one or more ports or inlets of the inlet valve structure engage or otherwise coupled with PDC tubes arrange in an annulus type configuration. As such, although a flat disk is shown as the valve structure 105, various embodiments of the present invention are not limited to this configuration.

During operation of the shown embodiments, the valve structure 105 rotates about a central axis which is coincident with a central axis of a grouping of PDCs 103 arranged in an annulus type pattern. As shown, the valve structure 105 contains a plurality of inlet ports 104. This can be seen in each of FIGS. 2 through 5. As the valve structure 105 rotates the inlet ports 104 "engage" with PDCs 103 to allow air/fuel flow from upstream of the valve structure 105 (such as from the compressor stage 101) through the ports 104 and into the PDCs 103. As the structure 105 rotates each of the ports 104 becomes engaged with PDCs 103 during the rotation.

Figure 2:
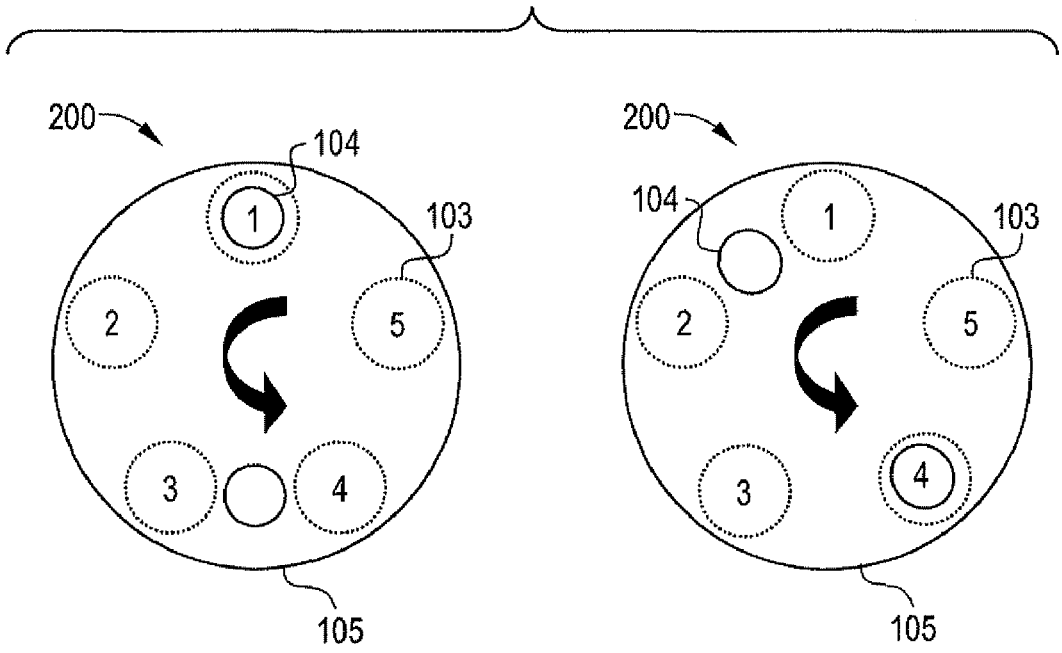
FIG. 2 shows a diagrammatical representation of an exemplary embodiment of the present invention with five PDCs.

Consistent with the various embodiments of the present invention, the embodiment shown in FIG. 2 has a non-integer tube/port ratio. That is the embodiment shown is a 5/2 configuration—having 5 PDCs to 2 inlet ports. Therefore, the ratio is 2.5. The operation of this embodiment will now be described.

As can be seen, each of the PDCs 103 has been identified with a number (1, 2, 3, 4 and 5), and the structure 105 is rotating in a counter-clockwise direction. In the first (left) figure from FIG. 2 the upper most port 104 is engaged with the #1 PDC 103, thus allowing the #1 PDC to fill, as required for PDC operation. Then as the structure 105 continues to rotate the bottom port 104 engages with the #4 PDC 103 to allow this PDC. During the fill of #4 PDC 103 the #1 PDC is fired (i.e., detonated), and once the #4 PDC 103 is filled and the port 104 moves on the #4 PDC 103 is detonated. During operation, this sequencing is repeated as the structure 105 rotates, thus causing non-adjacent PDCs to fire, resulting in resonant detuning.

Thus, in FIG. 2 the filling pattern of the PDCs 103 is #1, 4, 2, 5, 3, 1, . . . while the detonation pattern or sequence will be #3, 1, 4, 2, 5, 3, . . . . This resultant firing pattern ensures that non adjacent PDCs 103 are fired in sequence.

Although the embodiment shown in FIG. 2 shows five PDCs 103 being employed, this number can be decreased to three or increased so long as the ratio remains a non-integer (e.g., 7, 9, etc.).

It is noted that although the ports 104 are shown as having a circular opening, it is contemplated that the shape of the opening can be changed to optimize flow into the PDCs 103. Further, the location and positioning of the ports 104 on the structure 105 can be optimized from what is shown (180 degrees from each other) to implement the desired performance. Additionally, although the rotation of the structure 105 is shown as counter-clockwise, the rotation can be reversed.

Figure 3:
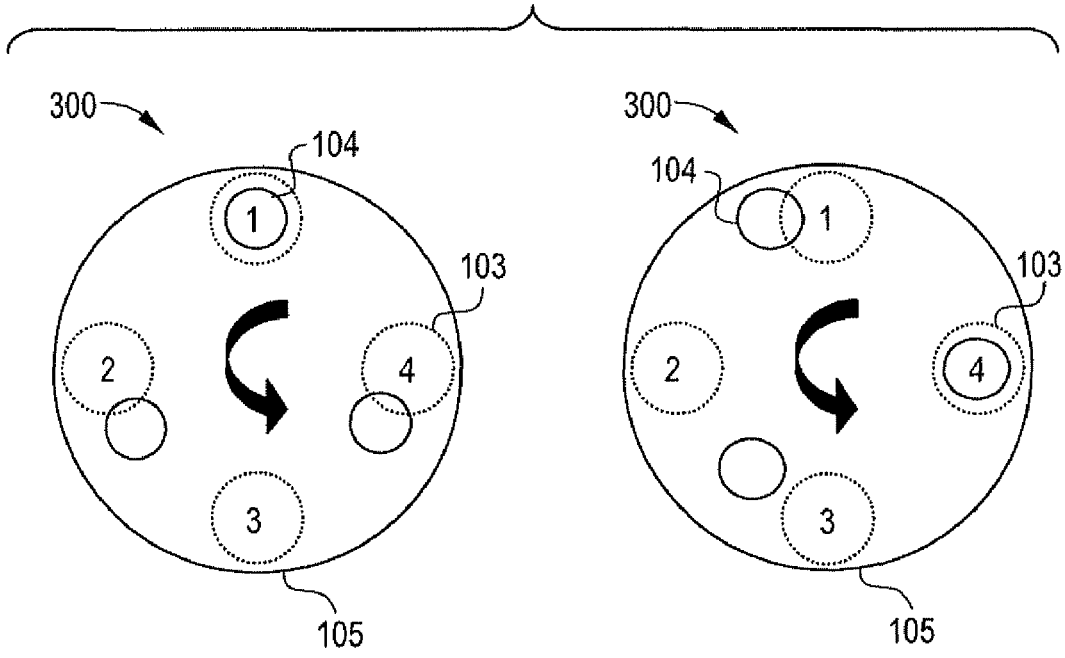
FIG. 3 shows a diagrammatical representation of an exemplary embodiment of the present invention with four PDCs.

Turning now to FIG. 3, an additional embodiment 300 is shown. In this embodiment, there are four PDCs 103 and three ports 104. Therefore, the tube-to-port ratio is 1.33. In this embodiment, the filling sequence of the PDCs 103 is #1, 4, 3, 2, 1, 4 . . . and the firing sequence is 2, 1, 4, 3, 2, 1, . . . . Therefore, this embodiment provides a counter-sequential firing pattern. That is the firing pattern or sequence of the PDCs 103 rotates in a direction opposite of rotation of the structure 105.

Figure 4:
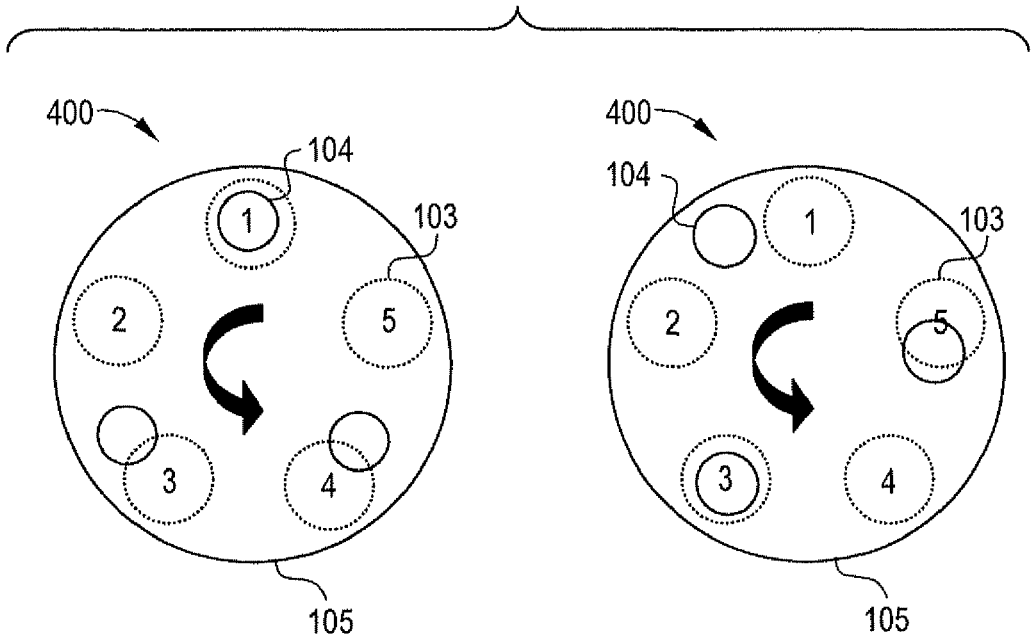
FIG. 4 shows a diagrammatical representation of another exemplary embodiment of the present invention with five PDCs.

The FIG. 4 embodiment 400 is similar to the embodiment shown in FIG. 2 except the tube-to-port ratio is 1.67 because there are five PDCs 103 and three ports 104. In this embodiment, the filling sequence of the PDCs 103 is #1, 3, 5, 2, 4, 1 . . . and the firing sequence is 4, 1, 3, 5, 2, 4, . . . . Therefore, this embodiment provides a star firing pattern. That is, the firing pattern or sequence of the PDCs 103 creates a star pattern, and no adjacent PDCs 103 are detonated sequentially.

Figure 5:
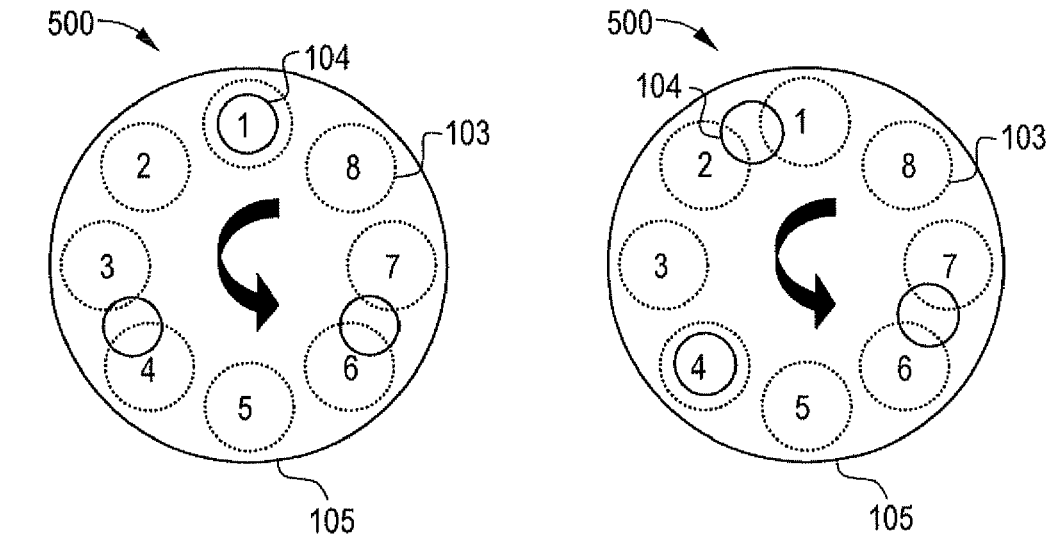
FIG. 5 shows a diagrammatical representation of an exemplary embodiment of the present invention with eight PDCs.

The FIG. 5 embodiment 500 shows an embodiment having a ratio of 2.67. There are eight PDCs 103 and three ports 104. In this embodiment, the filling sequence of the PDCs 103 is #1, 4, 7, 2, 5, 8, 3, 6, 1 . . . and the firing sequence is 6, 1, 4, 7, 2, 5, 8, 3, 6, . . . . Therefore, this embodiment provides a co-rotating star firing pattern. That is, the firing pattern or sequence of the PDCs 103 creates a star pattern (no adjacent PDCs 103 are detonated sequentially) and the firing sequence rotates in the same direction as the structure 105.

In addition to the embodiments shown, the present invention contemplates many other embodiments in which the ratio of PDCs 103 to ports 104 is a non-integer. The Table below shows additional contemplated embodiments of the present invention.

| Embodiment | PDCs | Ports | Ratio |
|---|---|---|---|
| A | 8 | 6 | 1.33 |
| B | 10 | 4 | 2.5 |
| C | 6 | 4 | 1.5 |
| D | 10 | 3 | 3.3 |
| E | 12 | 5 | 2.4 |
| F | 12 | 7 | 1.7 |
| G | 12 | 8 | 1.5 |
| H | 10 | 7 | 1.43 |
| I | 10 | 8 | 1.25 |

Of course, the present invention is not limited to the above additional exemplary embodiments of the present invention, but they are intended to demonstrate additional exemplary embodiments. As can bee seen, the present invention contemplates a PDC-to-port ratio of between 1 and 4 when the ratio is a non-integer.

Additionally, the present invention is not limited to embodiments where only a single PDC 103 is fired/detonated at one time. In fact, various embodiments of the present invention have two or more PDCs 103 which are fired/detonated simultaneously. On such embodiment is shown in FIG. 6.

Figure 6:
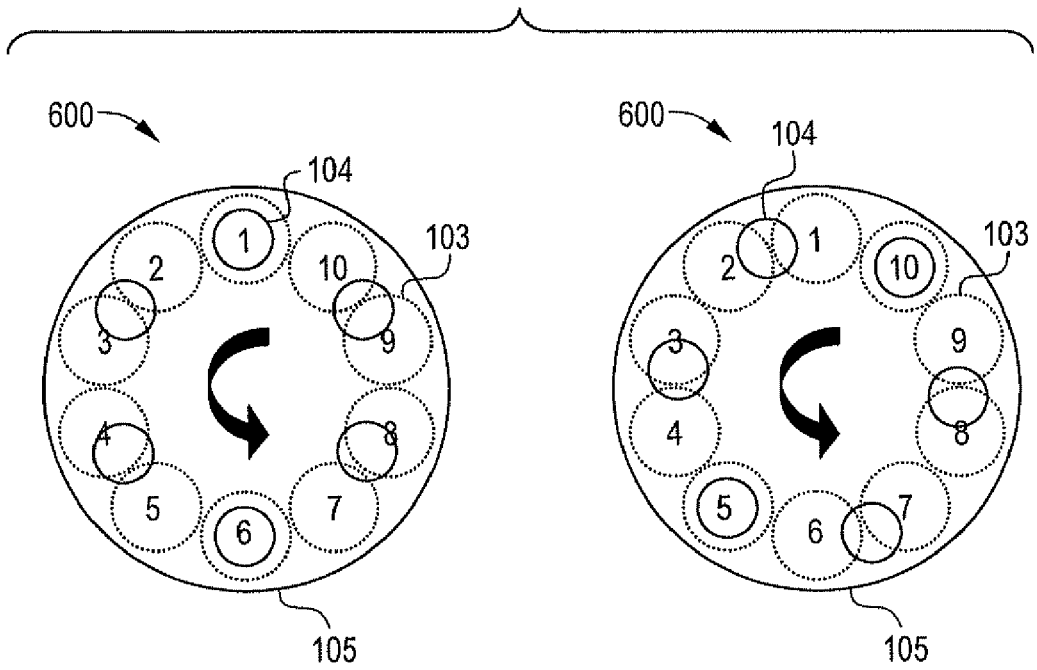
FIG. 6 shows a diagrammatical representation of an exemplary embodiment of the present invention with ten PDCs.

In the FIG. 6 embodiment 600 there are ten PDCs 103 (#1 through 10) and six ports 104. Differently than the embodiments shown in FIGS. 2 through 5, as the structure 105 rotates two PDCs 103 fill at the same time and two PDCs 103 detonate at the same time. This is because two ports 104 engage with PDCs 103 at the same time. This can be seen in the figures of FIG. 6. Thus, this embodiment provides a symmetrical loading relative to a centerline of embodiment 600. In the embodiment shown, the filling sequence is 1-6, 4-9, 2-8, 5-10, 3-7, 1-6, . . . and the firing sequence of the PDCs 103 is 3-7, 1-6, 4-9, 2-8, 5-10, 3-7, . . . (It is noted that for each PDC pairs shown—e.g., "1-6"—this means that PDCs #1 and #6 are filled or fired at the same time. This embodiment provides a counter-rotational firing sequence where every other PDC 103 is filled/fired.

It is noted that other configurations allow for the simultaneous firing of PDCs 103 as shown in FIG. 6. For example, an embodiment having eight PDCs 103 and six ports 104 would allow for the simultaneous filling/firing of two PDCs 103 at a time.

Figure 7:
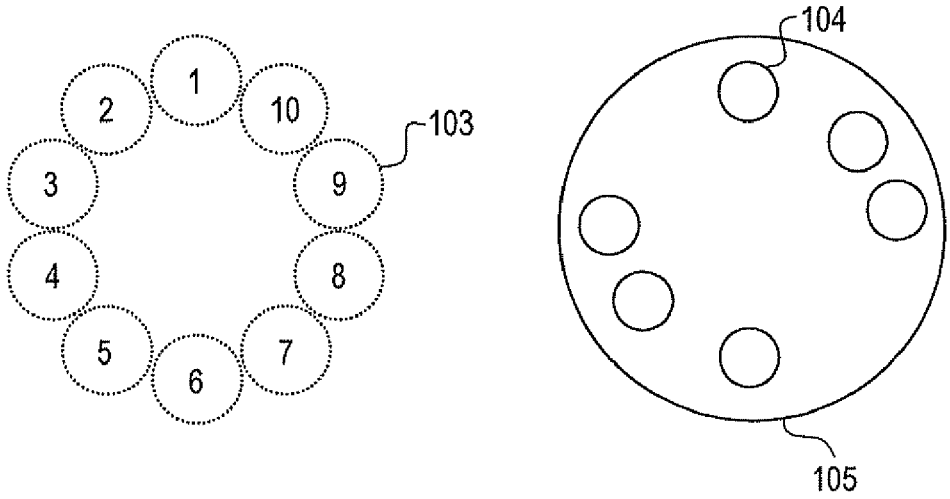
FIG. 7 shows a diagrammatical representation of yet another exemplary embodiment of the present invention with ten PDCs.

As briefly discussed previously, in addition to the symmetrical distribution of PDCs 103 and ports 104 (as shown in FIGS. 2 through 6) it is contemplated that either the ports 104 and/or the PDCs 103 can be distributed asymmetrically to achieved a desired performance or resonance detuning. Specifically, as shown in each of FIGS. 2 through 6 the PDCs 103 and ports 104 are distributed in an annulus fashion such that the angle between any two adjacent ports 104 or PDCs 103 is the same. However, in an asymmetric distribution it is contemplated that the angle between any two adjacent ports 104 and/or PDCs 103 is different than another angle between any two other adjacent ports 104 and/or PDCs 103. This embodiment is simplistically shown in FIG. 7 in which the inlet valve structure 105 is shown with asymmetrically distributed ports 104 and the PDCs 103 are distributed symmetrically. It is noted that the structure 105 is shown separately from the grouping of the PDCs 103 for clarity.

Of course, alternatively the PDCs 103 can be distributed asymmetrically while the ports 104 are symmetrical, or both the ports 104 and PDCs 103 are distributed asymmetrically. In such an embodiment, during operation a different number of PDCs 103 will be detonated at different times, contrary to the embodiments discussed above regarding FIGS. 2-6. That is, in the embodiment shown in FIG. 7, it is contemplated that the firing sequence of the PDCs 103 will be (4-5-9-10), (1-6), (3-4-8-9), (5-10), (2-3-7-8), . . . . Thus, the firing of PDCs 103 will alternate between four PDCs 103 and two PDCs 103. Therefore, if such performance was desired, it can be achieved with an embodiment similar to that shown in FIG. 7.

It is noted that although the present invention has been discussed above specifically with respect to aircraft and power generation applications, the present invention is not limited to this and can be in any similar detonation/deflagration device in which the benefits of the present invention are desirable.

While the invention has been described in terms of various specific embodiments, those skilled in the art will recognize that the invention can be practiced with modification within the spirit and scope of the claims.

What is claimed is:

1. An engine comprising:

a plurality of pulse detonation combustors; and a rotary inlet valve structure having a plurality of inlet ports through which at least air flows to enter said plurality of pulse detonation combustors during operation of said engine, wherein the ratio of said pulse detonation combustors to said inlet ports is a non-integer, and wherein at least one of said pulse detonation combustors and said inlet ports are distributed asymmetrically with respect to a central axis.

2. The engine of claim 1, wherein the non-integer is between 1 and 4.

3. The engine of claim 1, wherein the rotary inlet valve structure is a disk like structure on which said inlet ports are located.

4. The engine of claim 1, wherein said pulse detonation combustors are distributed in an annulus pattern having a central axis and said rotary inlet valve structure rotates about said central axis.

5. The engine of claim 1, wherein said inlet ports have a circular shape.

6. The engine of claim 1, wherein said inlet ports are distributed symmetrically on said rotary valve inlet portion.

7. The engine of claim 1, wherein said inlet ports are distributed on said rotary inlet valve portion such that no directly adjacent pulse detonation combustors are detonated sequentially during operation of said engine.

8. The engine of claim 1, wherein said inlet ports are distributed on said rotary inlet valve portion such that at least two pulse detonation combustors are detonated simultaneously during operation of said engine.

9. An engine comprising:

a compressor stage;

a plurality of pulse detonation combustors downstream of said compressor stage;

a rotary inlet valve structure having a plurality of inlet ports through which at least air flows to enter said plurality of pulse detonation combustors during operation of said engine; and a turbine stage downstream of said plurality of said pulse detonation combustors to receive an exhaust of said pulse detonation combustors, wherein the ratio of said pulse detonation combustors to said inlet ports is a non-integer, wherein the non-integer is between 1 and 4, wherein at least one of said pulse detonation combustors and said inlet ports are distributed asymmetrically with respect to a central axis.

10. The engine of claim 9, wherein the rotary inlet valve structure is a disk like structure on which said inlet ports are located.

11. The engine of claim 9, wherein said pulse detonation combustors are distributed in an annulus pattern having a central axis and said rotary inlet valve structure rotates about said central axis.

12. The engine of claim 9, wherein said inlet ports have a circular shape.

13. The engine of claim 9, wherein said inlet ports are distributed symmetrically on said rotary valve inlet portion.

14. The engine of claim 9, wherein said inlet ports are distributed on said rotary inlet valve portion such that no directly adjacent pulse detonation combustors are detonated sequentially during operation of said engine.

15. The engine of claim 9, wherein said inlet ports are distributed on said rotary inlet valve portion such that at least two pulse detonation combustors are detonated simultaneously during operation of said engine.

16. An engine comprising:

a compressor stage;

a plurality of pulse detonation combustors downstream of said compressor stage;

a rotary inlet valve structure having a disk like shape and a plurality of inlet ports having a circular shape through which at least air flows to enter said plurality of pulse detonation combustors during operation of said engine; and a turbine stage downstream of said plurality of said pulse detonation combustors to receive an exhaust of said pulse detonation combustors, wherein the ratio of said pulse detonation combustors to said inlet ports is a non-integer, wherein said pulse detonation combustors are distributed in an annulus pattern having a central axis and said rotary inlet valve structure rotates about said central axis, wherein the non-integer is between 1 and 4, and wherein at least one of said pulse detonation combustors and said inlet ports are distributed asymmetrically with respect to a central axis.

* * * * *